US006926627B1

(12) United States Patent
LeMire et al.

(10) Patent No.: US 6,926,627 B1
(45) Date of Patent: Aug. 9, 2005

(54) METHOD AND APPARATUS FOR DETERMINING COMPLIANCE OF A LACROSSE STICK HEAD

(75) Inventors: Laura E. LeMire, Catonsville, MD (US); Robert E. Griebe, Bel Air, MD (US)

(73) Assignee: STX, LLC, Baltimore, MD (US)

( * ) Notice: Subject to any disclaimer, the term of this patent is extended or adjusted under 35 U.S.C. 154(b) by 145 days.

(21) Appl. No.: 10/229,212

(22) Filed: Aug. 28, 2002

Related U.S. Application Data

(60) Provisional application No. 60/315,331, filed on Aug. 29, 2001.

(51) Int. Cl.[7] ..... A63B 59/02; A63B 65/12
(52) U.S. Cl. ..... 473/513; 473/505; 33/533
(58) Field of Search ..... 473/505, 513, 473/415; 73/379.02; 7/119; 33/613, 545, 33/501.08, 533, 645, 542

(56) References Cited

U.S. PATENT DOCUMENTS 1,159,025 A * 11/1915 Hess ..... 33/562
1,514,525 A * 11/1924 Hoke ..... 33/567
2,668,360 A * 2/1954 Keller ..... 33/562
3,156,984 A * 11/1964 Palmer ..... 33/613
3,797,123 A * 3/1974 Fraley ..... 33/501
4,528,759 A * 7/1985 Joyce et al. ..... 33/501
4,893,414 A * 1/1990 Samonek ..... 33/501
5,761,819 A * 6/1998 Ledy-Gurren ..... 33/501
6,082,015 A * 7/2000 Bjorkdahl ..... 33/555.2
6,138,371 A * 10/2000 Lippa et al. ..... 33/562
2001/0046908 A1 * 11/2001 Loomis et al. ..... 473/451

OTHER PUBLICATIONS

WebPage, TalkingTools, Dec. 19, 1996, www.bobvilla.com, 6 pages.*

* cited by examiner

*Primary Examiner*—Gregory Vidovich
*Assistant Examiner*—M. Chambers
(74) *Attorney, Agent, or Firm*—Pillsbury Winthrop Shaw Pittman LLP

(57) ABSTRACT

An apparatus and method for determining compliance of a lacrosse stick head with dimensional specifications that require a minimum allowable width between the two sidewalls of the head as measured at a designated distance from the stop member of the head. The apparatus has a width equal to the minimum allowable width of the lacrosse stick head, and a length perpendicular to the width. The length is equal to the designated distance. The apparatus is adapted to simultaneously measure the designated distance and the minimum allowable width. In a specific implementation, the apparatus has an upper rectangular portion connected to a lower triangular portion.

9 Claims, 7 Drawing Sheets

METHOD AND APPARATUS FOR DETERMINING COMPLIANCE OF A LACROSSE STICK HEAD

The application claims the benefit of U.S. Provisional Application No. 60/315,331, filed Aug. 29, 2001, which is herein incorporated by reference in its entirety.

BACKGROUND

1. Field of the Invention

The present invention relates generally to the game of lacrosse and to lacrosse sticks, and more particularly, to a method and apparatus for determining whether a head of a lacrosse stick complies with dimensional specifications of a lacrosse governing body.

2. Background of the Invention

NCAA and U.S. Lacrosse Women's lacrosse equipment rules (collectively, "Rules," and individually "Men's Rules" and "Women's Rules," respectively) require that lacrosse sticks adhere to certain dimensional requirements. The Rules prevent a lacrosse player from obtaining a competitive advantage over other players simply by virtue of modified or otherwise specialized lacrosse equipment. The Rules therefore specify minimum stick dimensions, maximum stick dimensions, or ranges of stick dimensions that provide equipment parameters for the men's game and the women's game. In addition, many lacrosse organizations not directly under the NCAA or U.S. Lacrosse umbrellas adopt the Men's Rules or the Women's Rules, greatly broadening the Rules' influence on the dimensional requirements of lacrosse equipment at all levels of play.

Of particular relevance to the present invention are rules relating to the size of the lacrosse stick head. These rules typically specify the overall width of the head, the width of the head at a point near the stop, the length of the head, and the height of the sidewalls of the head. In a lacrosse game, these dimensional requirements prevent a player from using a stick that unfairly protects the lacrosse ball within the pocket of the head, such that it is more difficult for opponents to check the ball free. For example, a lacrosse stick head having a width near its stop that is only slightly larger than the diameter of the ball would provide an unfair advantage in keeping the ball in the pocket in comparison to a head with a wider stop area.

As an example of lacrosse head dimensional specifications for competitive lacrosse, Rule I, Sections A-2-b and A-2-c, of the 2001 U.S. Lacrosse Rules for women's lacrosse outlines the following requirements:

"I. THE CROSSE

A. Field Crosse

. . .

2. Dimensions

. . .

b. Head: All width measurements are measured on a line perpendicular to the extension of the handle.

(1) Width overall 23 cm (9") maximum; 18 cm (7") minimum.

(2) Width when measured 3.2 cm (1¼") above the center of the stop where its bottom edge meets the plastic in a molded crosse or 3.2 cm (1¼") above the bridge in a wooden crosse, shall be 6.7 cm (2⅝") to 7.6 cm (3") inside and 7.6 cm (3") to 10.1 cm (4") outside. The stop is included where applicable for all inside measurements.

(3) Length: As measured from center of stop, where its bottom edge meets the plastic, or bridge to the top of the head, shall be 25.4 cm (10") minimum; 30.5 cm (12") maximum.

(4) Depth: Combined measurements of pocket containing ball with either wood or plastic wall shall not exceed 6.3 cm (2½") (Diameter of ball.)

c. Walls:

Wood or molded crosse 3.2 cm (1¼")–4.5 cm (1⅘") (measured at highest point of wall)

Guard soft or woven, 3.2 cm (1¼")–7.0 cm (2¾") (measured at highest point of wall)"

Thus, under these 2001 Women's Rules, a women's lacrosse stick head must be a minimum of 2.625" (or 2⅝" or 6.7 cm) wide (as measured perpendicular to the extension of the handle) at a point 1.25" (or 1¼" or 3.2 cm) above the stop area. The 1.25" dimension is measured from the molded (or wooden) frame of the lacrosse stick head, and not from a foam stop that may be attached to the stop. In addition, the height of the sidewall of the molded frame cannot exceed 1.8" (1⅘" or 4.5 cm) at the point of its greatest height.

As any game official (and even players and lacrosse equipment retailers) can appreciate, checking the compliance of a lacrosse stick head against these dimensional requirements is a difficult task, primarily due to the need to take two measurements at once. In other words, to verify the 2.625" minimum width requirement, an official must first measure 1.25" above the molded (or wooden) frame, and then simultaneously measure across the face of the head on a line perpendicular to the 1.25" measurement. To be accurate, this exercise requires two rulers held together perpendicular to each other, and secured in an exact orientation over the lacrosse stick head. In light of this burden, in most instances, the official ends up imprecisely "eye-balling" the 1.25" dimension when measuring the width of the head against the 2.625" minimum. Often, an official does not even have a ruler or other measuring device when confronted with a stick measurement on the field, therefore making exact measurements impossible. Thus, in the end, the official either makes an inaccurate measurement or no measurement at all.

SUMMARY OF THE INVENTION

The present invention is a method and apparatus for determining the compliance of a lacrosse stick head. The method and apparatus simultaneously measure the following two dimensions to verify rule compliance: 1) a first dimension measured from a point on the frame in the stop area of the head and toward the scoop of the head; and 2) a second dimension measured across the width of the head on a line drawn perpendicular to the extension of the lacrosse stick handle at a distance from the stop equal to the first dimension. The method and apparatus can also measure other dimensional requirements of a lacrosse stick, such as the sidewall height of a lacrosse stick head and the 2¾" "relatively straight" test for a lacrosse stick, as described in the Men's Rules.

An embodiment of the present invention, shown in FIG. 1*a*, has a rectangular top portion and a triangular bottom portion. One side of the rectangular portion is used to measure a dimensional requirement X of a lacrosse stick, such as the minimum allowable width of a lacrosse stick head near the stop area. The other side of the rectangular top portion can be used to measure another dimensional requirement Y of a lacrosse stick, such as the minimum or maximum allowable sidewall height of a lacrosse stick head. The triangular portion is used to measure a distance Z from a point on the inside frame of a lacrosse stick head to a point interior to the head, as outlined by the frame. For example, the triangular portion can measure a distance from a point at the center of the stop to a point above the center of the stop that is along the axis of the lacrosse stick handle and in the general plane of the head.

An alternative embodiment of the present invention is triangular, with no rectangular portion. With reference to FIG. 1*a*, this alternative apparatus measures dimensions X and Z, but not Y.

According to these embodiments, the apparatus is placed inside the face of a lacrosse stick head with the triangular portion pointing to the stop of the head. The apparatus is then moved in the direction of the stop to determine the compliance of the lacrosse stick head. In moving the apparatus, if the rectangular portion of the apparatus wedges up against the sidewalls of the head (i.e., two sides of the rectangle touch the sidewalls such that the apparatus cannot move any closer to the stop), then the head is illegal. Conversely, in moving the apparatus toward the stop, if the rectangular portion does not touch the sidewalls, or only slightly touches the sidewalls, such that the point of the triangle is able to touch the frame of the head at the center of the stop, then the head is legal.

Corresponding to typical dimensional requirements of lacrosse stick heads, the dimensions X, Y, and Z of the apparatus allow it to fit inside a game official's pocket. Taking advantage of this feature, in another embodiment of the present invention, the apparatus is colored so that it can be used as a signaling device for the game of lacrosse.

Accordingly, an object of the invention is to conveniently check the dimensional compliance of a lacrosse stick head.

Another object of the present invention is to simultaneously measure two dimensions on a lacrosse stick head.

Another object of the present invention is to provide an apparatus for signaling events, such as penalties, that occur in a lacrosse game.

These and other objects and advantages of the present invention are described in greater detail in the detailed description of the invention, and the appended drawings. Additional features and advantages of the invention will be set forth in the description that follows, will be apparent from the description, or may be learned by practicing the invention.

DETAILED DESCRIPTION OF THE INVENTION

Figure 1A:
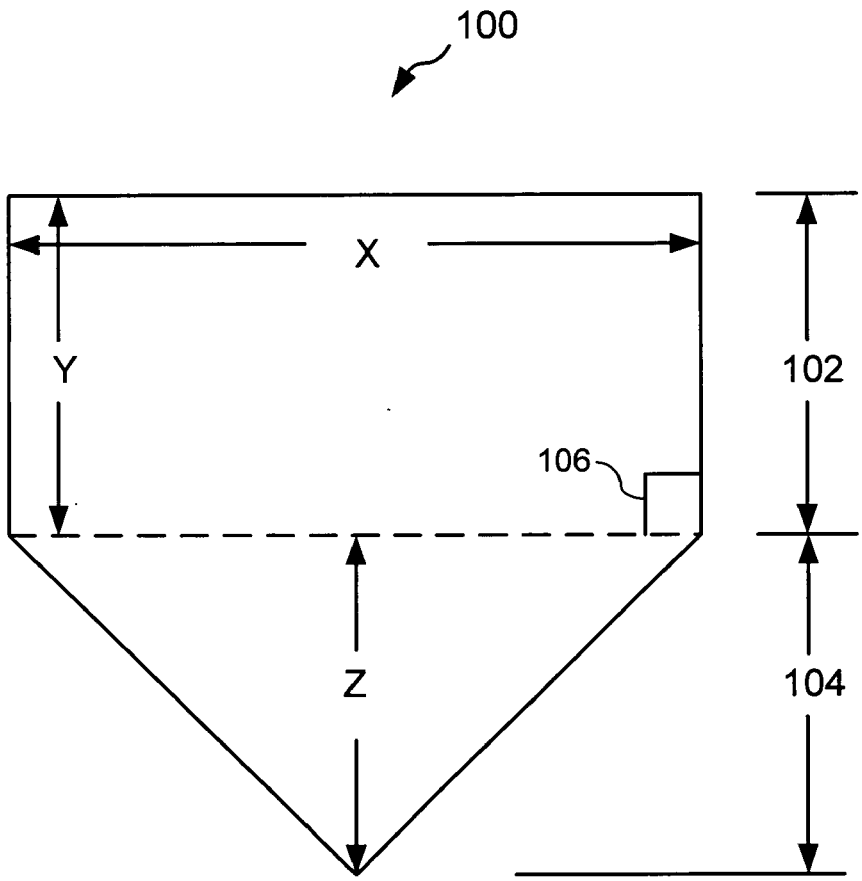
FIG. 1*a* is a schematic diagram of an apparatus for determining the compliance of a lacrosse stick head, according to an embodiment of the present invention.

FIG. 1*a* illustrates a gauge 100 for determining the compliance of a lacrosse stick head, according to an embodiment of the present invention. As shown, gauge 100 includes two functional portions: upper portion 102 and lower portion 104.

Upper portion 102 measures distances X and Y. Distance X corresponds to a dimensional requirement of a lacrosse stick, such as the minimum allowable width of a lacrosse stick head near the stop area. Distance Y corresponds to another dimensional requirement of a lacrosse stick, such as the minimum or maximum allowable sidewall height of a lacrosse stick head. As examples of these distances, according to the 2001 Women's Rules, distance X would equal 2.625" and distance Y would equal 1.25" (minimum) or 1.8" (maximum). Preferably, to measure distances X and Y, upper portion 102 is formed at right angles as represented by symbol 106.

Lower portion 104 measures a distance Z from a point on the inside frame of a lacrosse stick head to a point interior to the head, as outlined by the frame. Preferably, lower portion 104 measures distance Z along the axis of the extension of the lacrosse stick handle and centered along the width of distance X. As an example, distance Z equals 1.25", as required by Rule I-A-2-b-(2) of the 2001 Women's Rules.

In an alternative embodiment, the gauge is triangular in shape. In other words, with reference to FIG. 1*a*, this alternative gauge has only lower portion 104, without upper portion 102. In this configuration, the gauge measures distances X and Z, but not Y.

Although shown as a triangle in the example of FIG. 1*a*, as one of ordinary skill in the art would appreciate, lower portion 104 could be any shape that measures distance Z at the center of distance X, including a semicircle or even a single thin member. In any case, the shape of lower portion 104 decreases in width as it extends away from upper portion 102, and is in no instance greater in width than the width of upper portion 102 (i.e., distance X). This decreasing width permits gauge 100 to fit within the stop area of a lacrosse stick head and to simultaneously measure two dimensions (discussed below in reference to the method of the present invention).

In the embodiment of FIG. 1*a*, upper portion 102 is a rectangle and lower portion 104 is a triangle, making the overall shape of gauge 100 a five-sided polygon (similar to the shape of a baseball home plate).

Figure 1B:
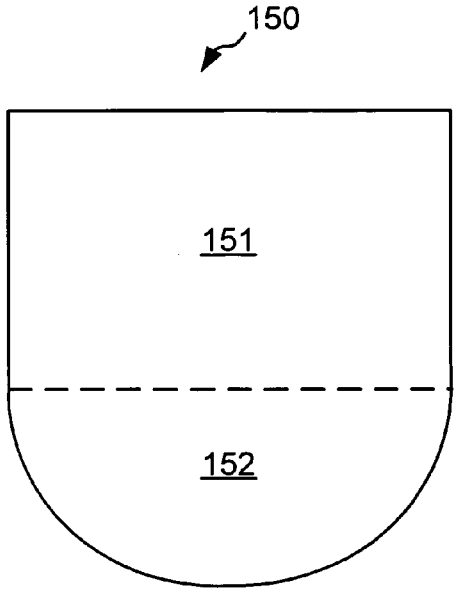
FIGS. 1*b*–1*d* are schematic diagrams of differently shaped apparatus for determining the compliance of a lacrosse stick head, according to alternate embodiments of the present invention.
Figure 1C:
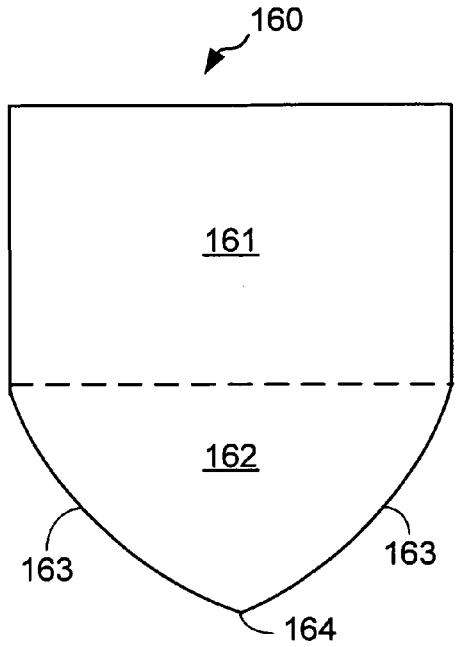
Figure 1D:
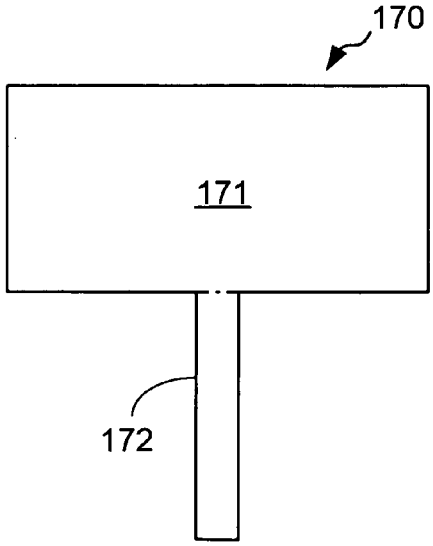

FIGS. 1*b*–1*e* illustrate alternately shaped gauges, according to further embodiments of the present invention. FIG. 1*b* illustrates a gauge 150 having a rectangular upper portion 151 and a semicircular lower portion 152. FIG. 1*c* illustrates a gauge 160 that has a rectangular upper portion 161 and a lower portion 162 with arcuate sides 163 leading to a point 164. FIG. 1*d* illustrates a gauge 170 having a rectangular upper portion 171 and a lower portion 172 shaped as a long narrow member.

Figure 1E:
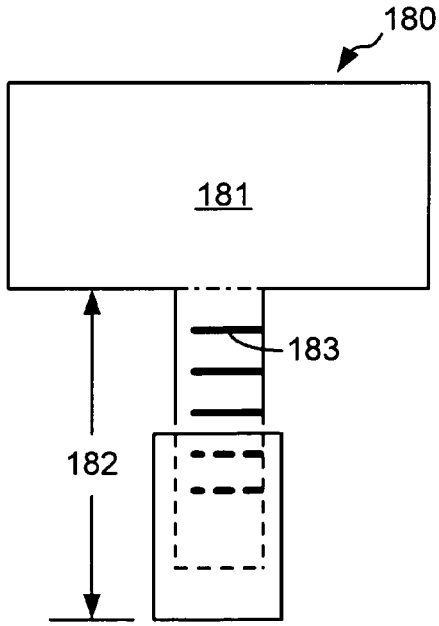
FIG. 1*e* is a schematic diagram of an adjustable apparatus for determining the compliance of a lacrosse stick head, according to an alternate embodiment of the present invention.

FIG. 1*e* illustrates a gauge 180 having a rectangular upper portion 181 and an adjustable lower portion 182. Lower portion 182 extends and retracts to enable a user to check compliance with different values of distance Z. This embodiment is especially useful for using a single gauge to check lacrosse stick heads against different dimensional specifications of the various lacrosse governing bodies, and to check a single stick at multiple locations to confirm compliance with different dimensional specifications. Optionally, lower portion 182 also includes markings 183 to indicate at which point to set the length of lower portion 182 to comply with the different rules. Markings 183 could be a value, such as "1.25 inches," or could be the name of the applicable rule, such as "U.S. Lacrosse Women's Rules," or some abbreviation thereof.

Figure 2:
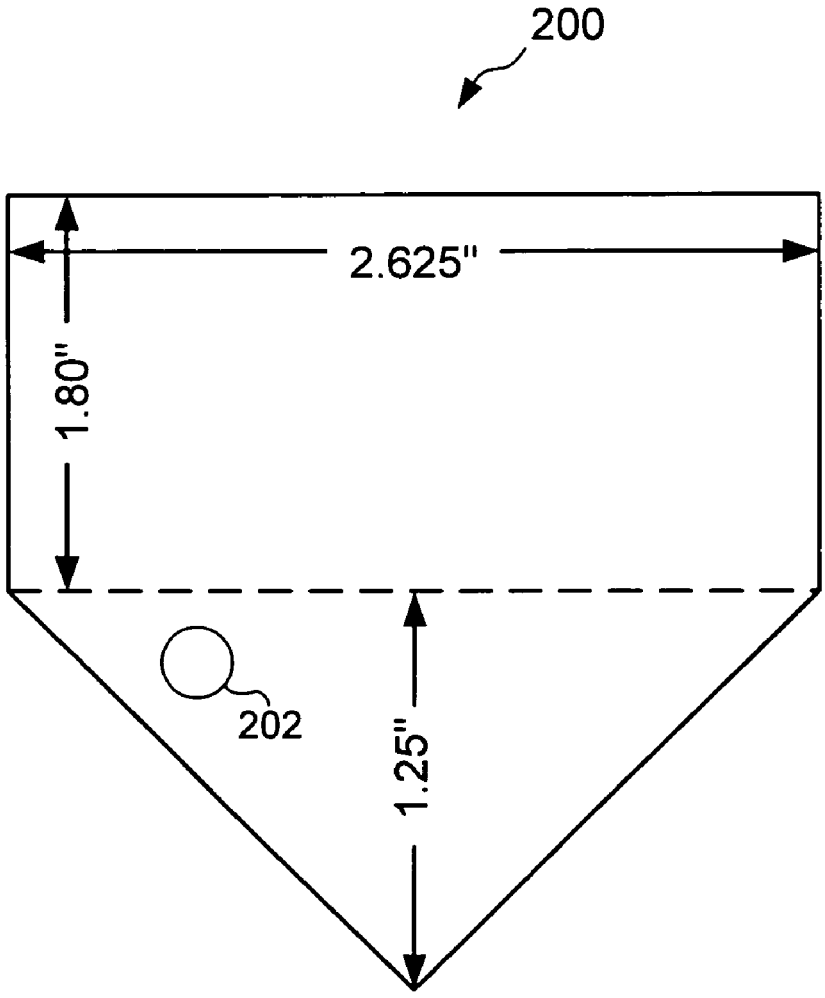
FIG. 2 is a schematic diagram of the apparatus of FIG. 1*a*, where the apparatus has indicia that indicate the applicable dimensional rules.

FIG. 2 illustrates a gauge 200 in which distances X, Y, and Z (of the similarly shaped gauge 100 of FIG. 1*a*) are labeled to indicate to the user the rules to which gauge 200 applies. (The labeling includes the numbers and their corresponding arrows, as well as the dotted line separating upper portion 102 from lower portion 104.) Thus, in the example of FIG. 2, gauge 200 includes indicia for the 1.25", 2.625", and 1.8" dimensions required by Sections A-2-b and A-2-c of Rule I of the 2001 Women's Rules.

Of course, in any specific implementation, distances X, Y, and Z (as shown FIG. 1*a*) and their corresponding indicia (as shown in FIG. 2) would match the rules for which the gauge is intended, including Men's Rules, Women's Rules, and other competitive rules. For example, for a gauge designed for men's lacrosse, distance Y could equal 2" to measure the height of the sidewall and distance X could equal 2¾" to perform the "relatively straight" test known in the Men's Rules. The "relatively straight" test requires a crosse to be relatively straight from the butt end to the end of the head. A relatively straight crosse is defined as one that may be laid flat on a tabletop on the side opposite the netting so that a substantial portion of the crosse rests on the table and such that there is a distance from the tabletop to the bottom edge of the head that at no point exceeds 2¾".

Figure 3:
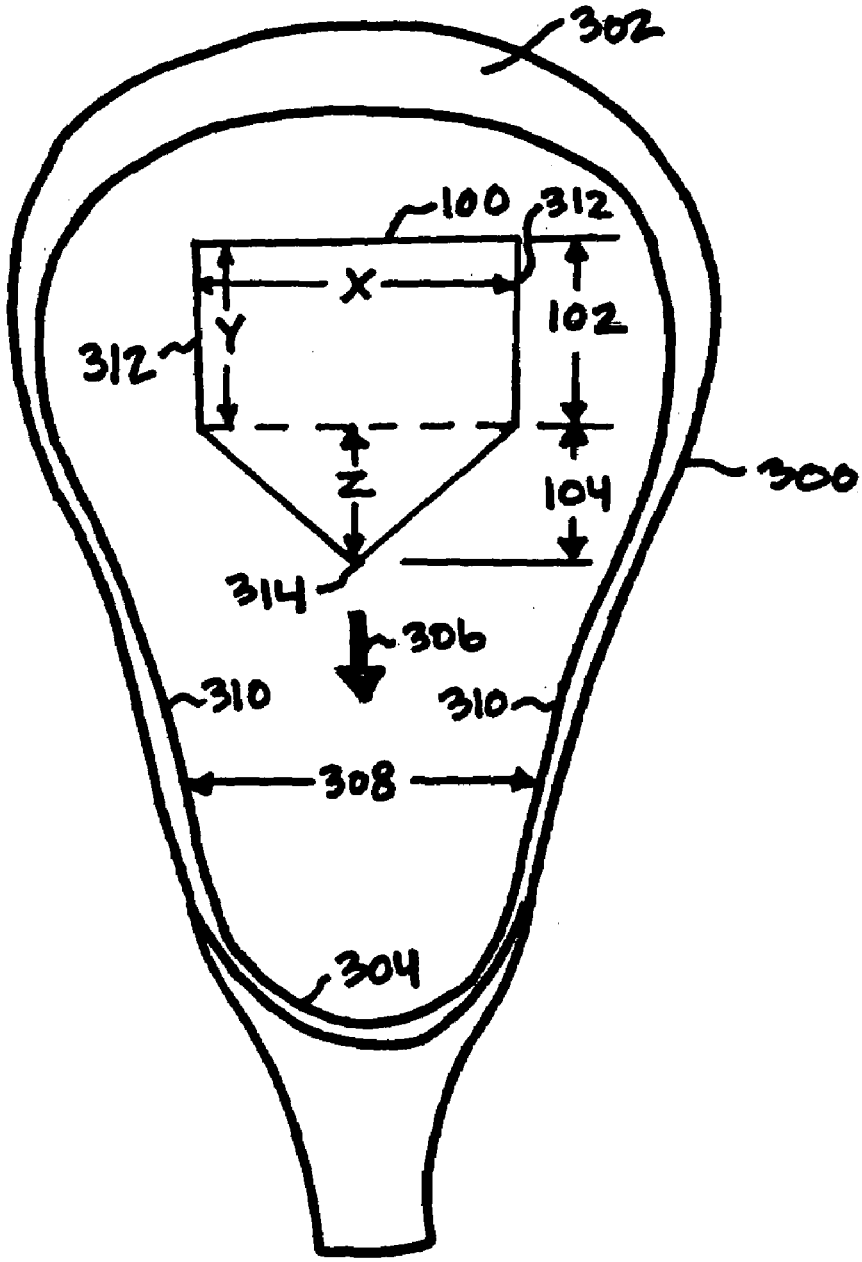
FIGS. 3–6 are schematic diagrams illustrating methods for determining the compliance of a lacrosse stick head using the apparatus of FIG. 1*a*, according to an embodiment of the present invention.

FIGS. 3–6 illustrate methods for determining the compliance of a lacrosse stick head using gauge 100 of FIG. 1*a*. As shown in FIG. 3, gauge 100 is first placed inside a lacrosse stick head 300 near the scoop 302 of head 300. Gauge 100 is oriented such that upper portion 102 is nearest scoop 302 and lower portion 104 is nearest the stop area 304 of head 300. Gauge 100 is also held in a horizontal plane that is approximately equal to or parallel to the general plane of the head 300.

Figure 4:
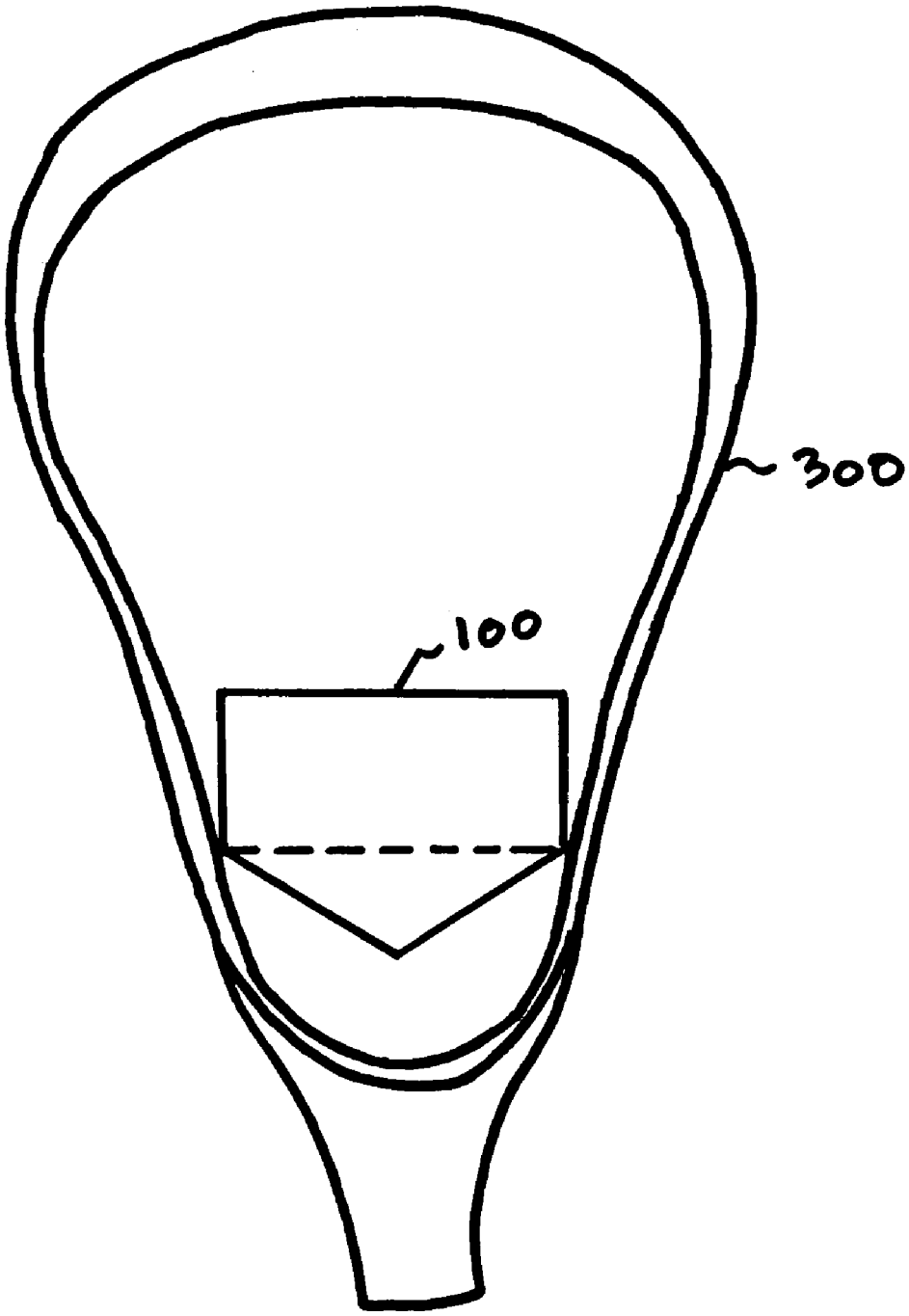

After gauge 100 is placed inside the upper portion of head 300, gauge 100 is then moved in its same horizontal plane toward stop area 304, as represented by the arrow 306 in FIG. 3. As gauge 100 is moved toward stop area 304 in a direction substantially perpendicular to the stop member and substantially parallel to sidewalls 310, the width 308 between sidewalls 310 of head 300 narrows. To comply with the pertinent rules, this width 308 must remain greater than distance X, as measured from the center of stop area 304 to a distance Z in the direction of scoop 302 along the axis of the handle (not shown). Thus, as gauge 100 moves toward stop area 304, if the sides 312 of gauge 100 contact sidewalls 310 such that gauge 100 can no longer move freely and such that point 314 of gauge 100 does not contact stop area 304, then head 300 is illegal. That is, width 308 is less than distance X at a distance from stop area 304 equal to or greater than distance Z, therefore violating the applicable rules. This illegal situation is shown in FIG. 4.

Figure 5:
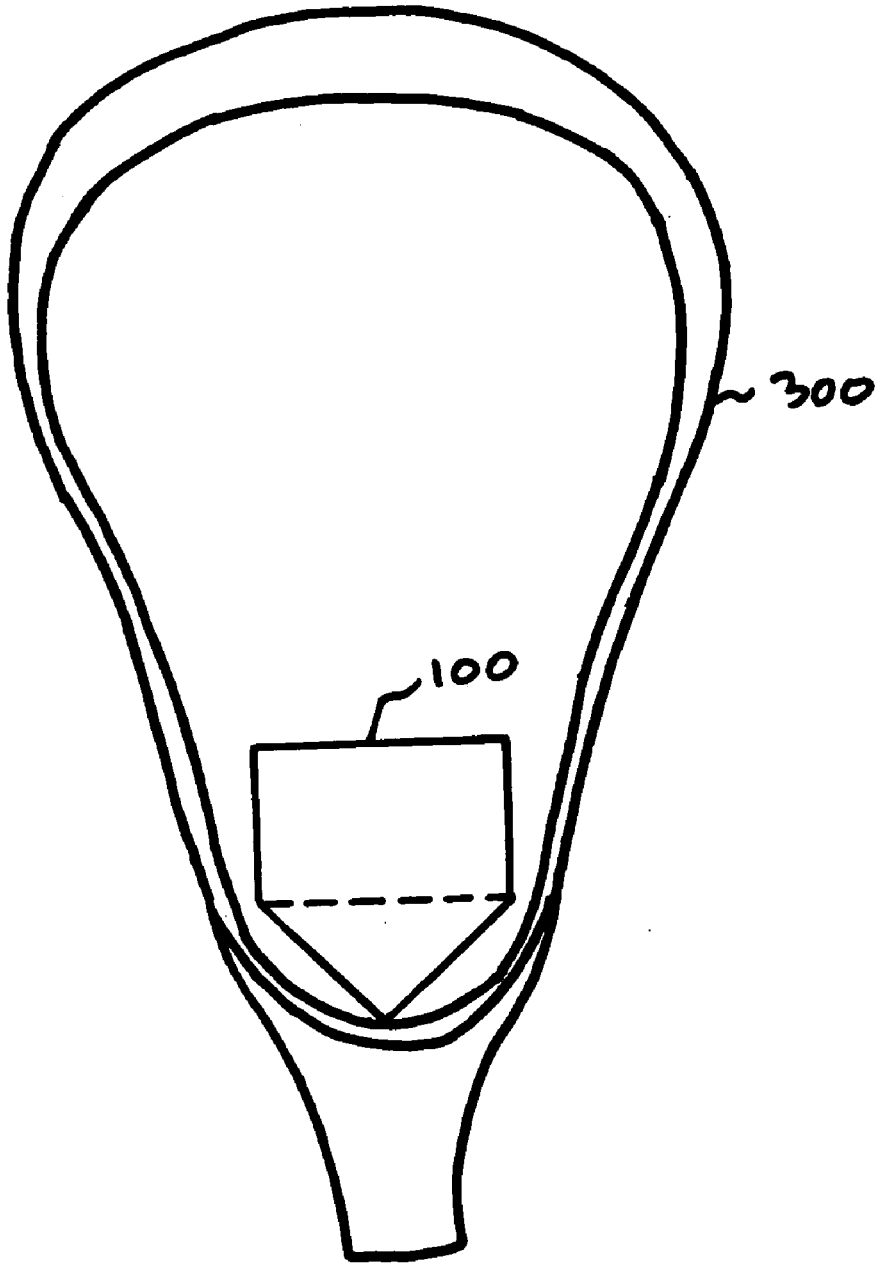

If, on the other hand, gauge 100 is moved toward stop area 304 without contacting sidewalls 310 such that point 314 does contact stop area 304, then head 300 is in compliance with the applicable rules. FIG. 5 illustrates this situation.

Although not shown in FIG. 3, stop area 304 often includes a foam stop, which can complicate the measuring of distance Z. Specifically, according to some lacrosse stick dimension rules, distance Z must be measured through the foam stop, which is typically 1/16" or 1/8" thick. For example, in the Men's Rules, gauge 100 must measure distance Z from the point where the foam stop meets the plastic of the head frame, and not from on top of the foam stop. Importantly, point 314 of gauge 100 (as shown in FIG. 3) facilitates this measurement by enabling a user to compress the foam stop to take the measurement from the plastic frame.

Figure 6:
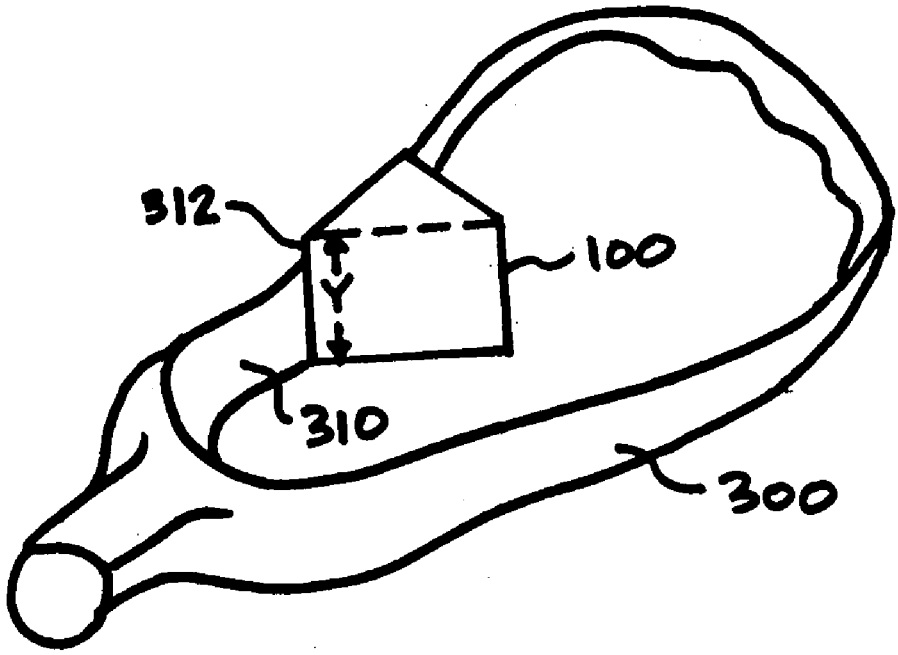

As additional functionality, in a further embodiment of the present invention, gauge 100 determines compliance with another dimensional requirement of a lacrosse stick, such as the maximum height of the sidewalls of a lacrosse stick head (e.g., 1.8" as required by Section A-2-c of Rule I of the 2001 Women's Rules). Gauge 100 determines compliance with the additional dimensional requirement based on distance Y of upper portion 102. As shown in the example of FIG. 6, to measure sidewall height, gauge 100 is held with a side 312 of upper portion 102 against sidewall 310 of head 300. If the height of sidewall 310 exceeds distance Y, then the lacrosse stick head is not in compliance.

As a further embodiment, the thickness of gauge 100 could be used to check compliance with another dimensional requirement of a lacrosse stick, such as the maximum allowable thickness of nylon strings, leather thongs, or a foam stop.

Thus, the present invention allows a user to conveniently check relevant lacrosse stick head dimensions using a single apparatus. The present invention simultaneously checks two dimensions and eliminates the need for the inaccurate "eyeballing" and ruler measurements of the prior art.

According to an embodiment of the present invention, gauge 100 is made of a durable material that does not expand or contract greatly with changes in temperature, thereby keeping the dimensions of gauge 100 constant and accurate. An example of a suitable material is a polycarbonate, such as LEXAN™.

In a further embodiment of the present invention, gauge 100 is colored so that it can be used as a signaling device for the game of lacrosse. For example, gauge 100 could be green, yellow, or red to serve as an official's card, which is used in women's lacrosse to signal the commission of certain fouls. In this manner, an official could carry one or more gauges in her pocket both to check sticks for compliance and to signal fouls.

To facilitate the carrying of multiple gauges, another embodiment of the present invention includes a hole in each gauge through which, for example, a chain or string can be threaded. As an example, FIG. 2 illustrates one possible position of a hole 202 in gauge 200. In this manner, a single chain can carry many gauges, which is especially useful if the gauges are also used as official's cards, as described above.

In describing embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, unless that order is explicitly described as required by the description of the process in the specification. Otherwise, one skilled in the art can readily appreciate that the sequences may be varied and still remain within the spirit and scope of the present invention.

Other embodiments of the invention will be apparent to those skilled in the art from consideration of the specification and practice of the invention disclosed herein. It is intended that the specification and examples be considered as exemplary only, with a true scope and spirit of the invention being indicated by the claims.

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. An apparatus for determining compliance of a lacrosse stick head, wherein the lacrosse stick head has a stop member, two sidewalls connected to the stop member, and a scoop connected to the two sidewalls opposite the stop member, the apparatus comprising:

(a) a first portion that measures a minimum allowable width of the lacrosse stick head; and (b) a second portion connected to the first portion, wherein the second portion measures a distance from the stop member to a point at which the first portion measures the minimum allowable width, wherein the second portion is shaped as one of a triangle, a semicircle, a triangle with arcuate sides leading to a point, and a long narrow member, and wherein the second portion is adjustable such that the second portion is adapted to measure multiple distances from the stop member.

2. The apparatus of claim 1, wherein the first portion measures one of a minimum and maximum allowable height of the two sidewalls.

3. An apparatus for determining compliance of a lacrosse stick head, wherein the lacrosse stick head has a stop member, two sidewalls connected to the stop member, and a scoop connected to the two sidewalls opposite the stop member, the apparatus comprising:

(a) a first portion that measures a minimum allowable width of the lacrosse stick head; and (b) a second portion connected to the first portion, wherein the second portion measures a distance from the stop member to a point at which the first portion measures the minimum allowable width;

wherein the first portion measures one of a minimum and maximum allowable height of the two sidewalls;

wherein the first portion is shaped as a rectangle having a first side equal to the minimum allowable width and a second side equal to the one of the minimum and maximum allowable height, and wherein the first side is connected to the second portion; and wherein the second portion is adjustable such that the second portion is adapted to measure multiple distances from the stop member.

4. The apparatus of claim 1, wherein the apparatus is colored for use as a signaling device by a lacrosse game official.

5. The apparatus of claim 1, wherein the apparatus has an opening adapted to receive one of a chain and a string.

6. An apparatus for determining compliance of a lacrosse stick head with dimensional specifications, wherein the lacrosse stick head has a stop member, two sidewalls connected to the stop member, and a scoop connected to the two sidewalls opposite the stop member, and wherein the dimensional requirements require a minimum allowable width between the two sidewalls as measured at a designated distance from the stop member, the apparatus comprising:

(a) a width equal to the minimum allowable width of the lacrosse stick head; and (b) a length perpendicular to the width, the length being equal to the designated distance;

wherein the apparatus is adapted to simultaneously measure the designated distance and the minimum allowable width; and wherein the length of the apparatus is adjustable such that the apparatus is adapted to measure multiple distances from the stop member.

7. The apparatus of claim 6, wherein the apparatus is shaped as a triangle having a base and a height, and wherein the base is the width and the height is the length.

8. The apparatus of claim 6, wherein the apparatus comprises a first portion and a second portion, wherein the first portion is a rectangle having a first side and a second side, wherein the first side is equal to the width, wherein the second portion is connected to the first side and extends from a midpoint of the first side for the designated distance.

9. The apparatus of claim 8, wherein the second portion is shaped as a triangle having a base and a height, wherein the base is connected to the first portion, and wherein the height coincides with the midpoint of the first side of the rectangle.

* * * * *